US008336270B2

(12) United States Patent
Vagedes

(10) Patent No.: US 8,336,270 B2
(45) Date of Patent: Dec. 25, 2012

(54) CUSTOM SHUTTER

(75) Inventor: Michael Vagedes, Florence, KY (US)

(73) Assignee: Alpha Systems, LLC, Elkhart, IN (US)

( * ) Notice: Subject to any disclaimer, the term of this patent is extended or adjusted under 35 U.S.C. 154(b) by 102 days.

(21) Appl. No.: 12/886,787

(22) Filed: Sep. 21, 2010

(65) Prior Publication Data

US 2012/0066995 A1 Mar. 22, 2012

(51) Int. Cl.
*E06B 9/01* (2006.01)
*E06B 9/02* (2006.01)

(52) U.S. Cl. ..... 52/473; 52/458; 52/457; 52/455

(58) Field of Classification Search ..... 52/473, 52/455, 458, 586.2, 457, 474, 302, 309.1, 52/314; 403/331, 363, 361
See application file for complete search history.

(56) References Cited

U.S. PATENT DOCUMENTS

| | | | | |
|---|---|---|---|---|
| 3,055,467 | A | 9/1962 | Peek et al. | |
| 3,455,079 | A * | 7/1969 | Frederick | 52/473 |
| 3,797,186 | A * | 3/1974 | Smith | 52/314 |
| 4,251,966 | A * | 2/1981 | Foltman | 52/309.1 |
| 4,765,110 | A * | 8/1988 | MacLeod | 52/473 |
| 4,858,400 | A * | 8/1989 | Foyt | 52/98 |
| 4,967,511 | A | 11/1990 | Werginz et al. | |
| 5,060,442 | A * | 10/1991 | Chubb | 52/473 |
| 5,152,116 | A * | 10/1992 | MacGowan | 52/473 |
| 5,163,260 | A | 11/1992 | Ricard et al. | |
| 5,265,391 | A | 11/1993 | Ricard et al. | |
| 5,347,782 | A * | 9/1994 | Vagedes | 52/473 |
| 5,430,986 | A * | 7/1995 | Vagedes | 52/473 |
| 5,524,407 | A | 6/1996 | Ricard et al. | |
| 5,530,986 | A | 7/1996 | Rackley, Sr. | |
| 5,617,688 | A | 4/1997 | Gandy et al. | |
| 5,622,018 | A * | 4/1997 | Schiedegger | 52/211 |
| 5,634,998 | A * | 6/1997 | Schiedegger et al. | 156/73.1 |
| 5,704,182 | A * | 1/1998 | Schiedegger | 52/457 |
| D393,077 | S | 3/1998 | Dover | |
| 5,761,865 | A * | 6/1998 | Schiedegger et al. | 52/473 |
| 5,782,052 | A * | 7/1998 | Lacy | 52/473 |
| 5,826,393 | A | 10/1998 | Wenzlaff et al. | |
| 5,924,255 | A | 7/1999 | Vagedes | |
| 5,930,952 | A | 8/1999 | Ricci | |
| 5,946,873 | A * | 9/1999 | Schiedegger et al. | 52/457 |
| 5,996,298 | A | 12/1999 | Wenzlaff et al. | |
| 6,023,905 | A * | 2/2000 | Schiedegger | 52/745.19 |
| 6,122,875 | A * | 9/2000 | Schiedegger et al. | 52/457 |
| 6,125,581 | A | 10/2000 | Grossman | |
| 6,141,938 | A * | 11/2000 | Schiedegger | 52/745.19 |
| 6,263,632 | B1 | 7/2001 | Cadorette | |
| 6,397,540 | B1 * | 6/2002 | Schiedegger | 52/311.2 |
| 6,470,639 | B1 | 10/2002 | Horn et al. | |
| 6,560,941 | B1 | 5/2003 | French | |
| 6,732,475 | B1 | 5/2004 | Lee | |

(Continued)

*Primary Examiner* — Phi Dieu Tran A
(74) *Attorney, Agent, or Firm* — Wood, Herron & Evans, LLP

(57) ABSTRACT

A custom shutter includes a central body portion and first and second end caps. The central body portion includes two stiles and a central portion all of which are formed integrally as one piece. The top and bottom end caps include first and second legs and a central connecting body portion. The legs are designed to be inserted within the hollow interior of the stiles with the top edges of the stiles resting against the stepped portions of said end cap and wherein an inner surface of said end cap covers any exposed edge of the central portion of the shutter body.

6 Claims, 6 Drawing Sheets

U.S. PATENT DOCUMENTS

| | | | | |
|---|---|---|---|---|
| 6,968,656 | B2 | 11/2005 | Schiedegger et al. | |
| 7,380,385 | B2 | 6/2008 | Yoon | |
| 7,392,628 | B2 | 7/2008 | Logan et al. | |
| 2005/0284023 | A1* | 12/2005 | O'Hair | 49/74.1 |
| 2006/0174570 | A1* | 8/2006 | Logan et al. | 52/473 |
| 2007/0193173 | A1* | 8/2007 | Coughlin et al. | 52/473 |
| 2008/0134609 | A1* | 6/2008 | Vagedes | 52/473 |
| 2010/0058698 | A1* | 3/2010 | Verna et al. | 52/473 |
| 2011/0041430 | A1* | 2/2011 | Baughn et al. | 52/202 |

* cited by examiner

CUSTOM SHUTTER

BACKGROUND OF THE INVENTION

Plastic shutters that are used to decorate the exterior of a house are normally formed in a single mold. Because of this molding process, standard sizes are manufactured at a reasonable cost. Occasionally, non-standard-sized shutters are required.

It is too expensive to have molds for every possible size. Therefore, manufacturers have developed customizable shutters. These products require cutting portions of the shutter parts and various assembly techniques.

In many of these customizable shutters, separate stiles are employed which connect to slats. Caps are positioned on the top and bottom. An example of this is disclosed in Vagedes U.S. Pat. No. 5,924,255. Others simply cut off the portions of the top and bottom of a preformed shutter and add an end cap. Such shutters are disclosed in Gandy U.S. Pat. No. 5,617,688 and Vagedes U.S. Pat. Nos. 5,530,986 and 5,347,782.

It is very important that customized shutters have the appearance of a standard molded shutter. In other words, it is important not to be able to detect cut edges. It is also important that the assembly process not be labor intensive and, of course, the overall product must be aesthetically appealing.

SUMMARY OF THE INVENTION

The present invention is premised on the realization that a customizable shutter can be formed wherein only straight cuts at 90 degree angels are made at the top and bottom of a preformed shutter body that includes both stiles. Such cuts are easily made with available equipment. A special end cap is formed that includes legs that fit into the hollow interior of the stiles with an end cap body portion that has a generally stepped configuration allowing the ends of the stiles to butt up against the end cap, giving the appearance of a finished shutter. Provision is also made to allow the inside wall of the stile to be concealed by the end cap. This can be used for both slatted shutters as well as raised panel shutters.

The objects and advantages of the present invention will be further appreciated in light of the following detailed description and drawings in which:

DETAILED DESCRIPTION

Figure 1:
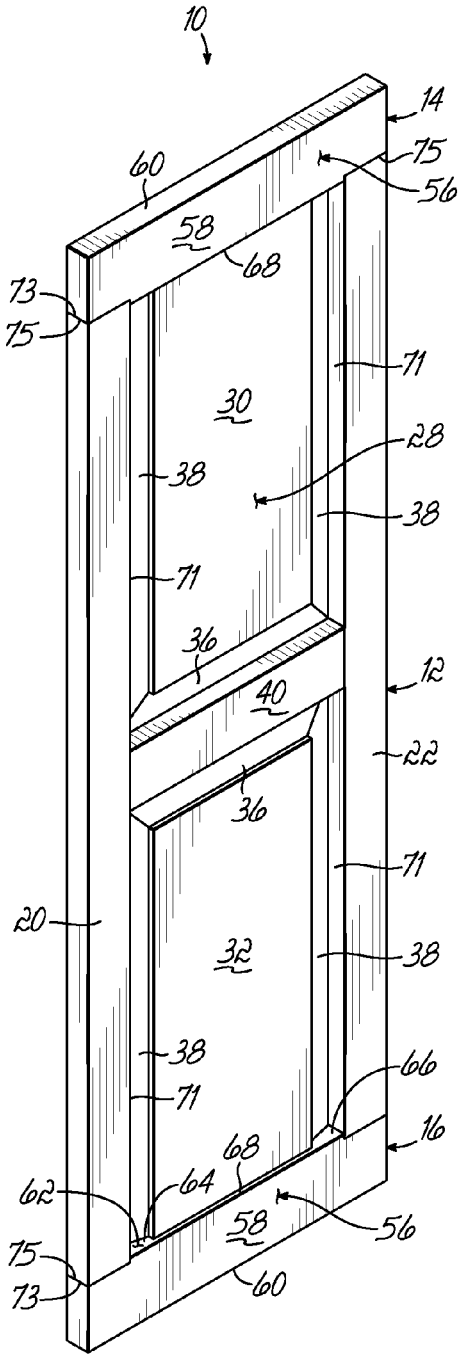
FIG. 1 is a perspective view of the present invention.

As shown in FIG. 1, a customizable shutter 10 includes a body portion 12, a first end cap 14 and a second end cap 16.

The body portion 12 includes first and second stiles 20 and 22, each with hollow interior portions 24 and 26. The body portion 12 further includes a central portion 28 which is formed integrally with the first and second stiles 20 and 22. As shown in FIG. 1, shutter 10 is a raised panel shutter, which also includes first and second panels 30 and 32 with peripheral inner bevel portion 36 and side bevel portions 38. Separating the panels 30 and 32 is a cross member 40 which extends from stile 20 to stile 22.

The body portion 12 has a top edge 42 and a bottom edge 44. As can be seen, these edges are simply straight cuts that extend at a 90 degree angle from either of the two parallel stiles.

The end caps 14 and 16 both include first and second legs 52 and 54 and a body portion 56, which is perpendicular to legs 52 and 54 and has a narrow portion or width approximately equal to the width of stiles 22 and 20. The body portion 56 includes a front surface 58, an outer surface 60 and an inner surface 62. The inner surface 62 is designed to mate with the profile of the raised panels 30 or 32, and conceal the cut edge 42 or 44, respectively. As such, each of these inner surfaces 62 include a first and second wing portion 64 and 66 which are adapted to mate with the beveled side portions 38. Extended between the two winged portions is a narrow strip 68 which is adapted to contact and rest on the central panels 30 or 32. The wings 64 and 66 each have an outer edge 69 which is adapted to butt against an inner side wall 71 of the stiles 20 and 22. Thus, small channels 70 and 72 are provided between the legs 52 and 54 and the outer edges 69 of the wings 64 and 68.

Figure 2:
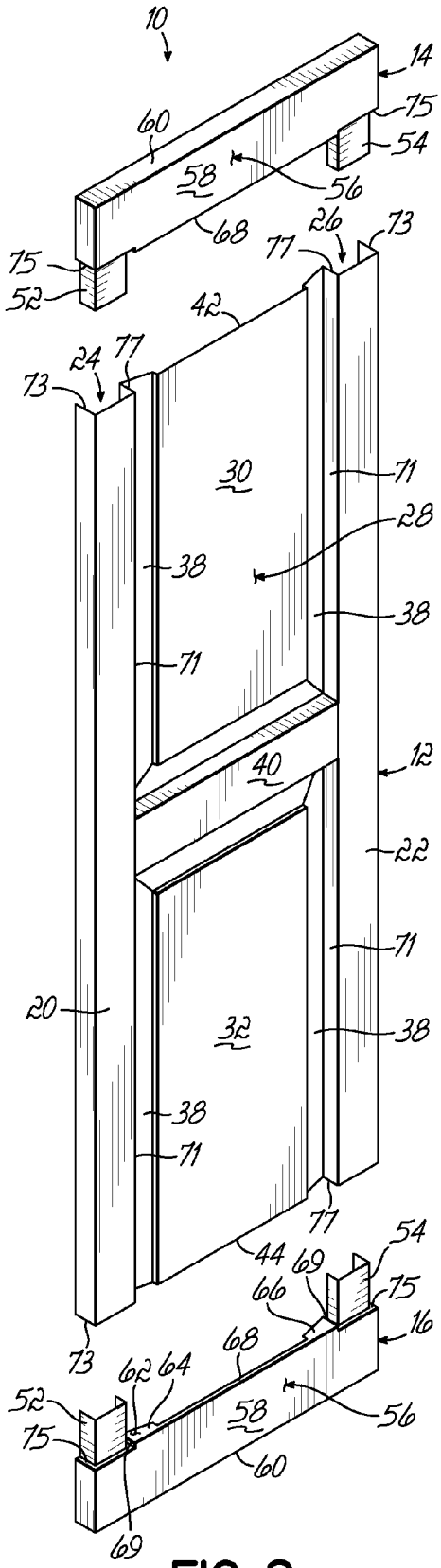
FIG. 2 is an exploded view of the present invention.
Figure 3:
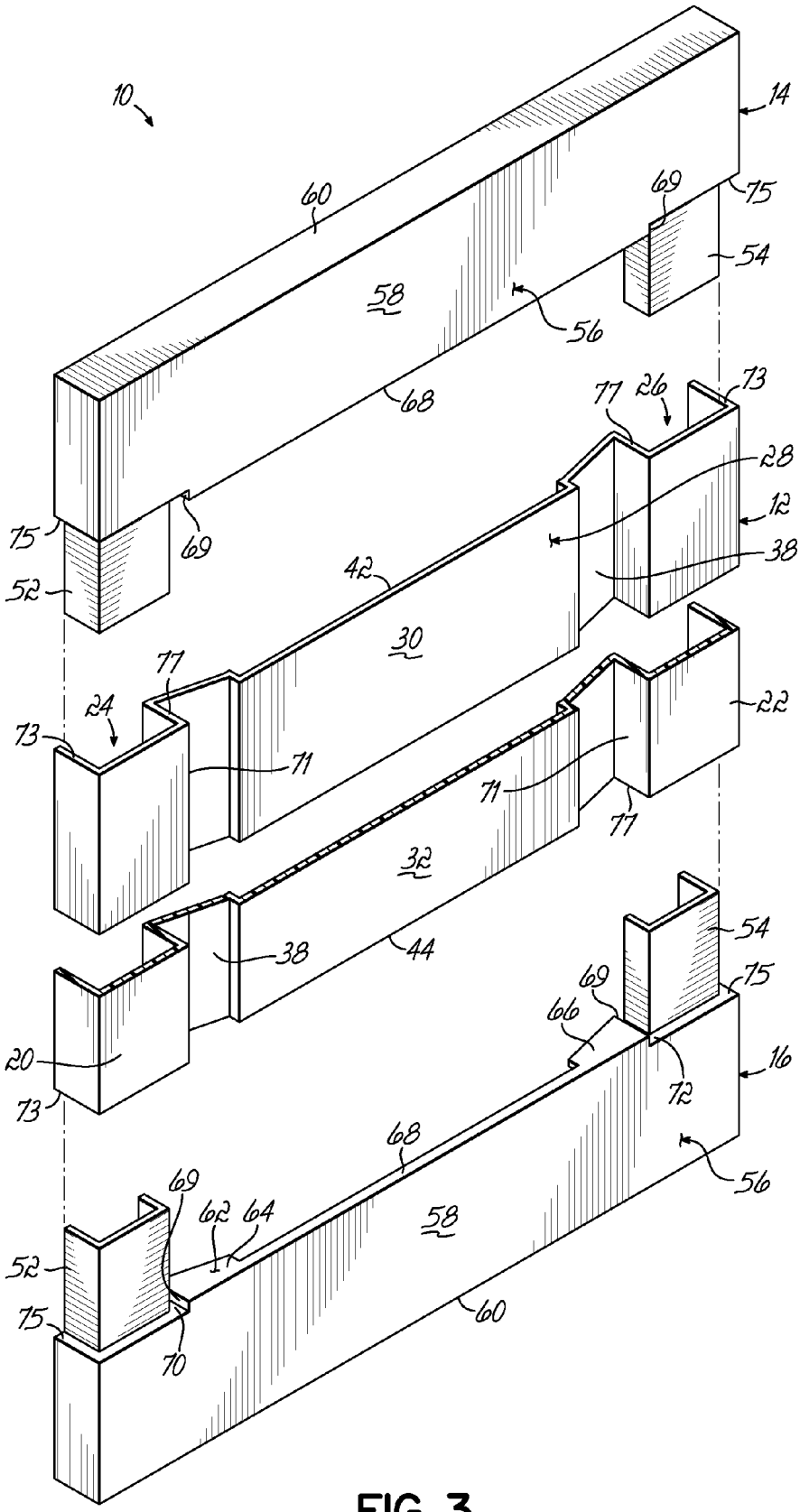
FIG. 3 is an exploded perspective view of the present invention with portions cut away.
Figure 4:
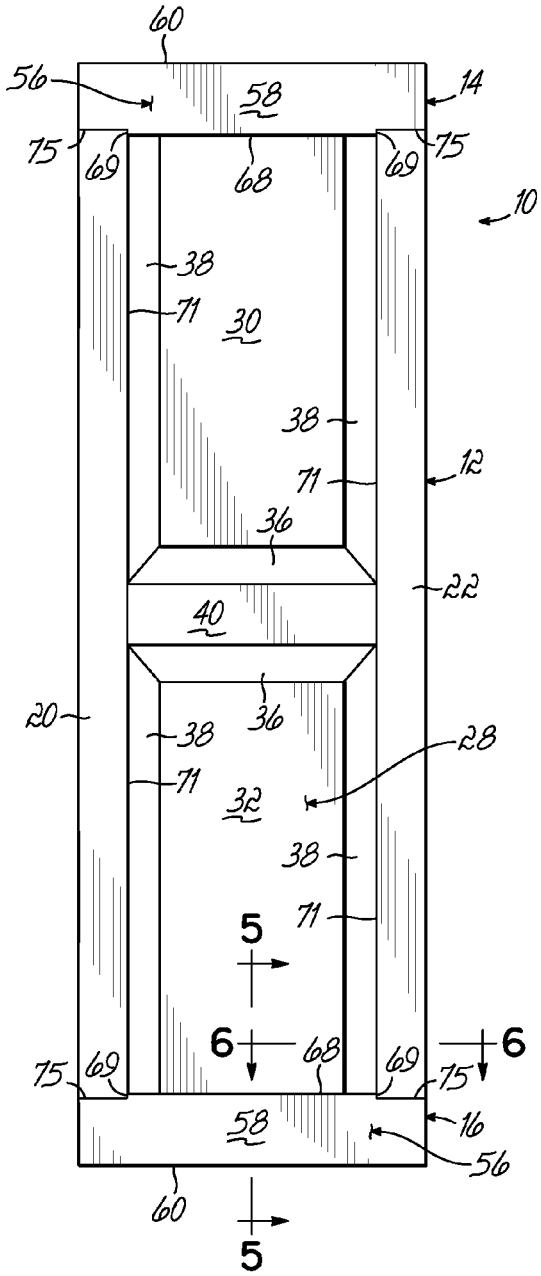
FIG. 4 is a plan view of the present invention.
Figure 5:
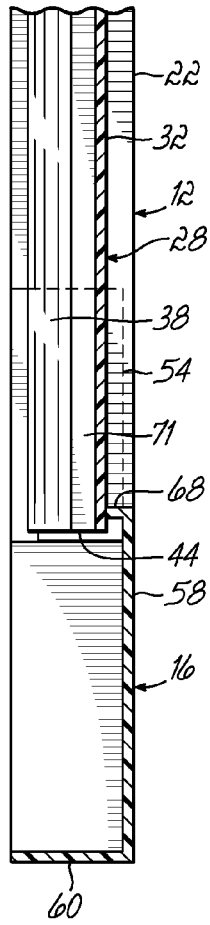
FIG. 5 is a cross sectional view taken at lines 5-5 of FIG. 4.
Figure 6:
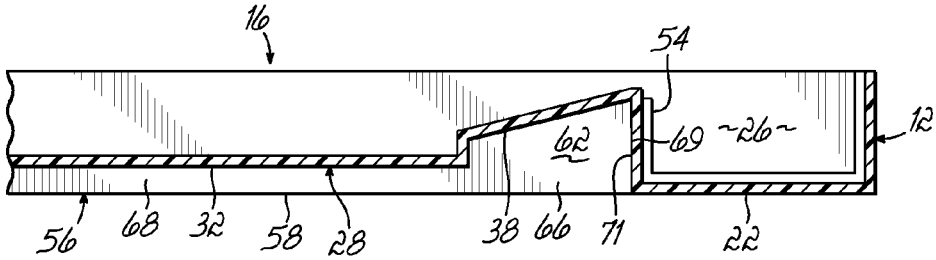
FIG. 6 is a cross sectional view taken at lines 6-6 of FIG. 4.
Figure 7:
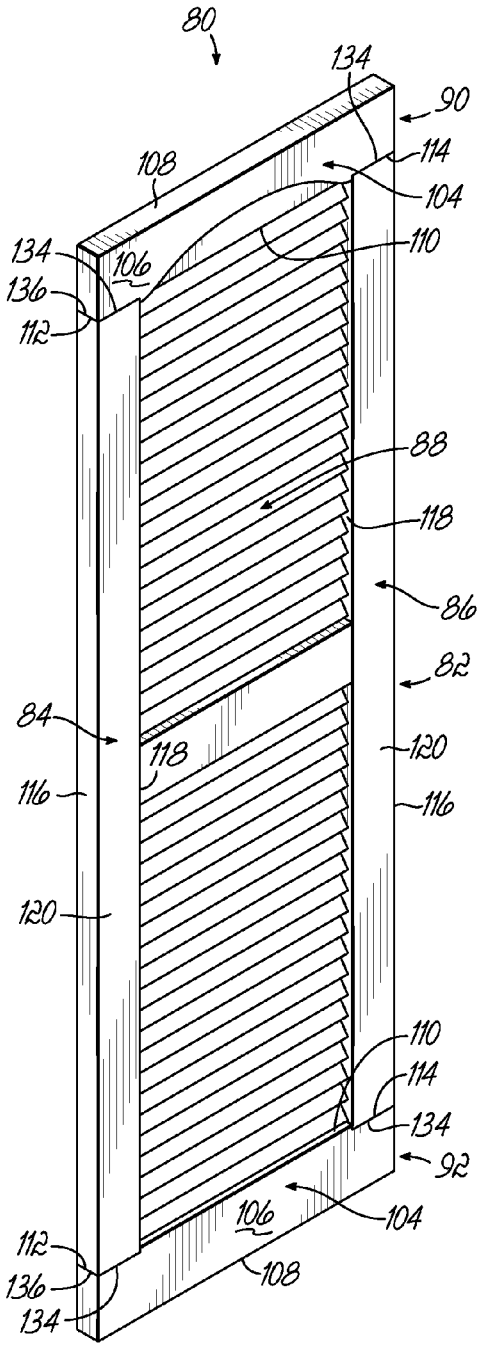
FIG. 7 is a perspective view of an alternate embodiment of the present invention.

As is shown in FIG. 2, the legs 52 and 54 have a cross sectional configuration adapted to mate with the interior surface of stiles 20 and 22 with the outer edges 73 of the stiles butted against stepped portions 75 in the end caps 14 and 16 at the juncture of the legs with the body portion 56. Inner edges 77 of the inner walls 71 of the stiles rest in channels 70 and 72 respectively.

To assemble these shutters, the body portion 12 is simply cut at 90 degree angles relative to the stiles 20 and 22 at the top and bottom to achieve a desired length. The legs 52 and 54 of the end caps are then inserted into the hollow interior of the stiles so that the outer edges of the stiles abut the stepped portions 75 of the end caps 14 and 16 with the inner walls 71 of the stiles located in channels 70 and 72 respectively. The interior wall 68 of the body 56 of the end caps cover the outer cut edges of the raised panel with the wing portions 64 and 66 resting immediately on the beveled portions and the edge 68 resting on the panel surface 28. Thus, the entire cut edges 42 and 44 on the top and bottom of the body portion 12 either abut stepped portions on the end cap or are concealed by the interior wall 68 of the end cap. The legs 52 and 54 can then be welded, adhered, or fastened to the stile surface to provide a unitary custom-sized shutter.

FIG. 7 to 12 show an alternate embodiment of the present invention and specifically a customizable slatted shutter 80.

Figure 8:
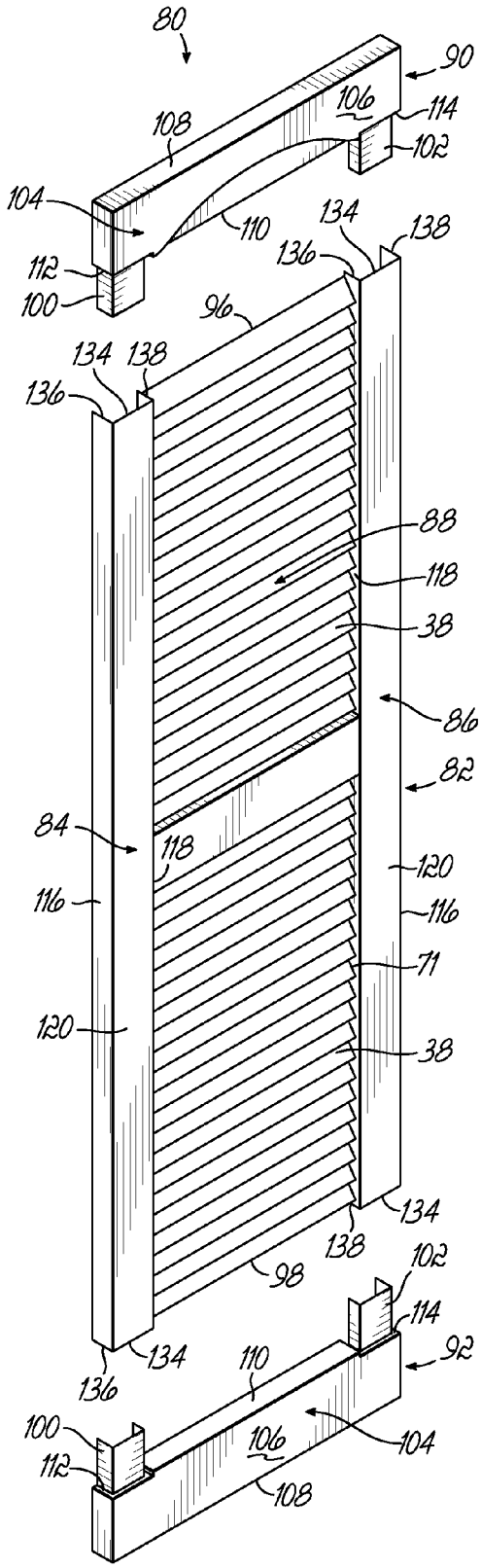
FIG. 8 is an exploded view of the embodiment in FIG. 6.
Figure 9:
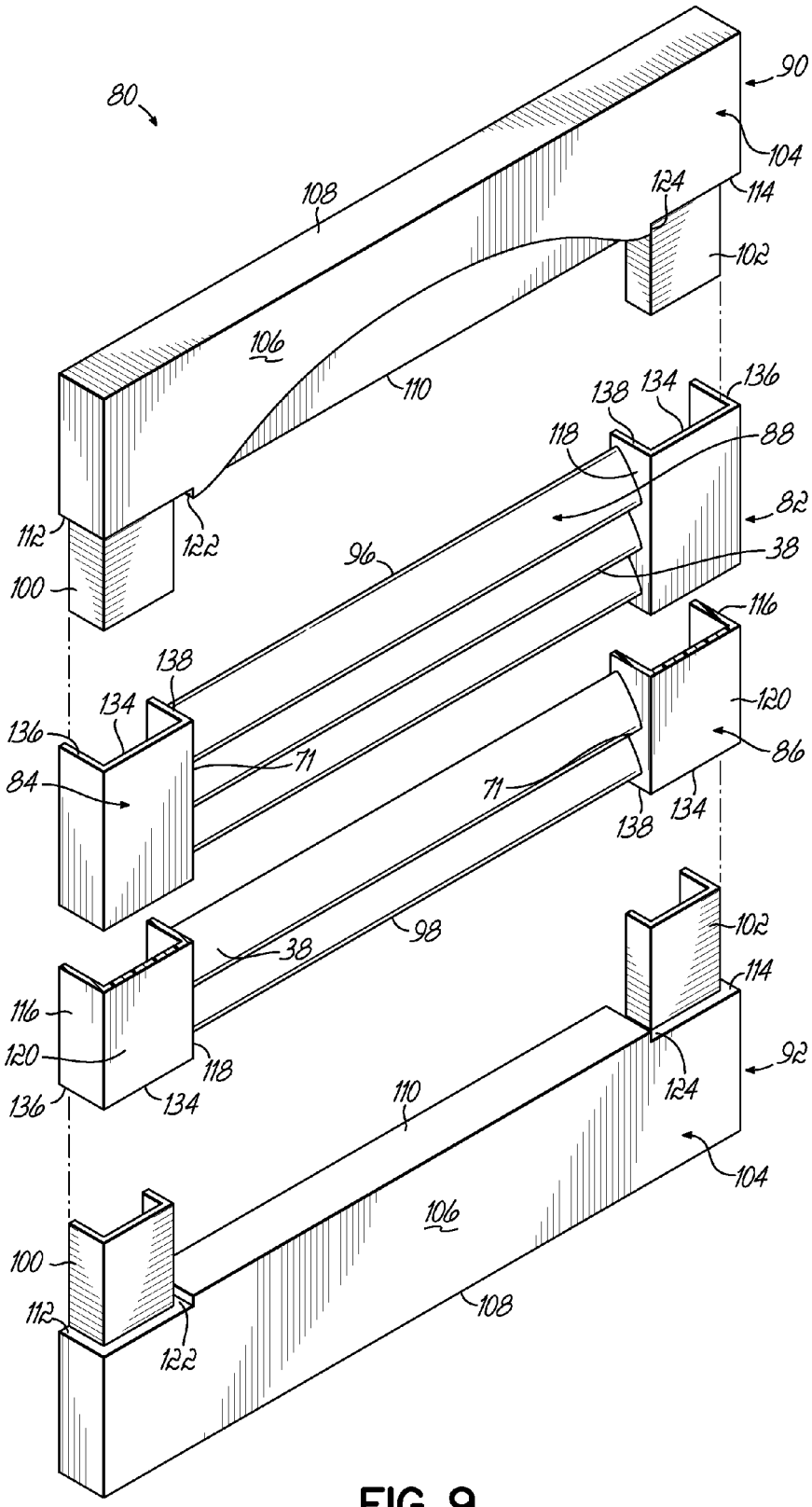
FIG. 9 is an exploded view of the embodiment shown in FIG. 6 with portions cut away.
Figure 10:
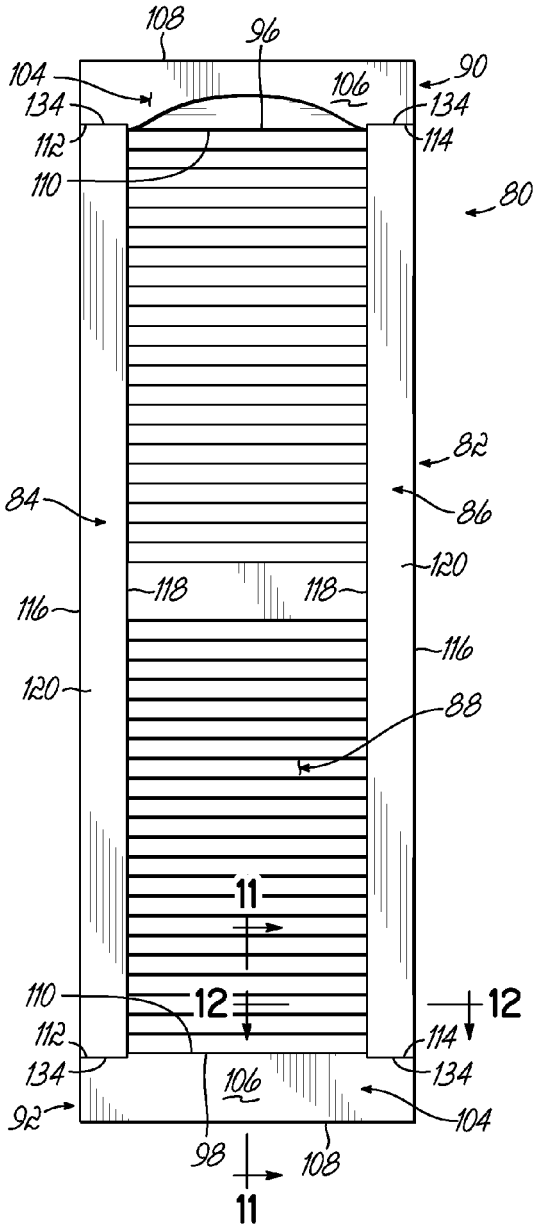
FIG. 10 is a plan view of the embodiment shown in FIG. 6.
Figure 11:
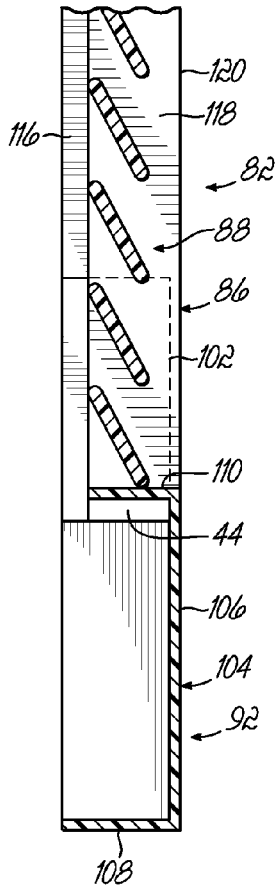
FIG. 11 is a cross sectional view taken at lines 11-11 of FIG. 10.
Figure 12:
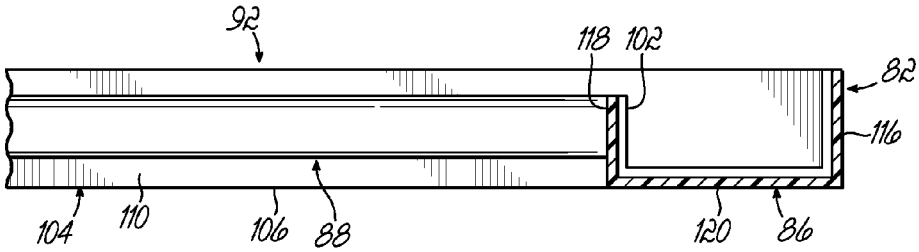
FIG. 12 is a cross sectional view taken at lines 12-12 of FIG. 10.

As shown in FIG. 8, shutter 80 includes a body portion 82 with first and second integral stiles 84 and 86 and a central slatted portion 88 and first and second end caps 90 and 92. Top and bottom edges 96 and 98 of the body portion 82 are cut edges, which extend 90 degrees relative to the two stiles to provide the desired size.

The end caps 90 and 92 include first and second legs 100 and 102 with a central body portion 104 that extends 90 degrees from the legs. The body portion includes a front surface 106, an outer surface 108 and an inner surface 110 which faces the slatted portion. The inner wall 110 is a very thin rectangular panel which extends from side to side and includes side edges spaced from legs 100 and 102 providing side channels 122 and 124. The legs 100 and 102 are sized to mate with the interior surface of the stiles 84 and 86 which, as shown, each includes an outer wall 116, an inner wall 118 and a top wall 120. The edges 134 and 136 of the top and outer walls 120 and 116 of the stiles abut against the stepped portions 112 and 114 between the legs 100, 102 and the body portion 104 of end caps 90, 92. Edges 138 of the inner wall 118 of stiles 84 and 86 rest in channels 122 and 124.

As with the raised panel shutter, the slatted shutter is formed by simply cutting body portion 82 and inserting the end caps 90 and 92. The legs 100 and 102 can then be welded, adhered, or fastened to the body portion at the interior surfaces of the stiles. The inner wall 110 of the caps will cover the edges 96, 98 of the body portion 82. The edges of the stiles will butt against the stepped portions 112 and 114 of the end caps 90 and 92 to provide a neat, clean appearance which will basically be identical to the pre-molded unitary shutters.

The present invention can, of course, be modified without departing from the scope of the invention. As an example, the leg portions of the end caps can be modified so that they do not take the exact configuration of the interior surface of the stiles, but can simply be a single tab or two tabs, as opposed to the three-walled structure shown in the present invention. As long as they can mate along one or more surfaces of the stiles, they can provide the needed stability for the assembled product.

This has been a description of the present invention along with the preferred method of practicing the present invention. However, the invention itself should only be defined by the appended claims,

I claim:

1. A custom shutter comprising a body portion, a first end cap and a second end cap;

said body portion including integral first and second parallel hollow stiles separated by an integral central portion, a top edge and a bottom edge wherein said edges are 90 degrees relative to said stiles;

each end cap having first and second legs having an interior surface which matingly engages with an interior surface of said stiles, a central member connecting said legs, said central member having an inner edge separated from said leg portions by a channel, said central member further including stepped portions along said legs configured to mate with leading edges of said stiles; and wherein said edge of said first end cap covers a portion of said top edge and wherein first and second inner edges of said stiles rest in said channels when said legs are inserted in said hollow stiles.

2. The custom shutter claimed in claim 1 wherein said central portion is slatted and wherein said inner edge of said central member is a straight edge.

3. The custom shutter claimed in claim 1 wherein said central portion has a raised panel configuration having beveled sides and said inner edge of said central member includes two wings adapted to mate with said beveled sides of said central portion and wherein said channels are between said wings and said legs.

4. The shutter assembly claimed in claim 1 wherein said legs each have three walls.

5. The custom shutter claimed in claim 1 wherein said legs have at least one wall which matingly engages at least one inner wall of each stile.

6. The custom shutter claimed in claim 1 wherein said legs of said endcaps extend from said channels and said stepped portions beyond said inner edges and from said channels and said stepped portions to beyond said inner edges of said encap.

* * * * *